US005605124A

United States Patent [19]

Morgan

[11] Patent Number: 5,605,124

[45] Date of Patent: Feb. 25, 1997

[54] ROTARY SCREW INTERNAL COMBUSTION ENGINE

[76] Inventor: Christopher K. Morgan, 2624 Tom Dr., Slaughter, La. 70777

[21] Appl. No.: 554,091

[22] Filed: Nov. 6, 1995

[51] Int. Cl.[6] ..... F02B 53/00

[52] U.S. Cl. ..... 123/222; 123/238; 123/239

[58] Field of Search ..... 123/222, 238, 123/239

[56] References Cited

U.S. PATENT DOCUMENTS

| | | | |
|---|---|---|---|
| 1,287,268 | 12/1918 | Edwards . | |
| 1,726,104 | 8/1929 | Harris . | |
| 2,511,441 | 6/1950 | Loubiere . | |
| 3,175,359 | 3/1965 | Szlechter . | |
| 3,693,601 | 9/1972 | Sauder . | |
| 3,940,925 | 3/1976 | Kelly . | |
| 4,222,231 | 9/1980 | Linn . | |
| 4,825,827 | 5/1989 | Yang | 123/222 |

FOREIGN PATENT DOCUMENTS

| | | | |
|---|---|---|---|
| 3627962 | 3/1988 | Germany | 123/239 |
| 58-160515 | 9/1983 | Japan | 123/238 |

*Primary Examiner*—Michael Koczo
*Attorney, Agent, or Firm*—David L. Ray

[57] ABSTRACT

A rotary internal combustion engine including a rotary screw compressor for receiving and compressing a mixture of air and fuel, a rotary positive displacement pump for receiving the compressed air and fuel mixture from the rotary screw compressor and pumping the mixture of compressed air and fuel therethrough, the pump having igniting means for igniting the mixture of compressed air and fuel inside of the pump, and a rotary screw expander for receiving the ignited mixture of compressed air and fuel and for expanding the volume of the ignited mixture of air and fuel therethrough.

18 Claims, 3 Drawing Sheets

ROTARY SCREW INTERNAL COMBUSTION ENGINE

BACKGROUND OF THE INVENTION

1. Field of the Invention

The invention relates to internal combustion engines. More particularly, the present invention relates to rotary type internal combustion engines.

2. Description of the Related Art

Rotary type internal and external combustion engines are known in the art. The ideal cycle that most automobile engines most closely approximate is the Otto cycle. The Otto cycle has a limitation on the work output in that the expansion ratio can be no greater than the compression ratio. This is inherent in the operation of the simple reciprocating internal combustion engine. The gasses at the end of the Otto cycle's isentropic expansion, however, could do more work if they were allowed to continue isentropic expansion to the lowest cycle pressure.

Exemplary of the Patents of the related art are the following U.S. Pat. Nos. 4,222,231; 3,940,925; 3,693,601; 3,175,359; 2,511,411; 1,726,104; and 1,287,268.

SUMMARY OF THE INVENTION

In accordance with the present invention there is provided a rotary screw internal combustion engine that can operate on a close approximation of the idealized complete combustion cycle also known as the Atkinson cycle. The Atkinson cycle includes the following sequential steps:

Step 1: Isentropic Compression

Step 2: Constant Volume Heat Addition

Step 3: Isentropic Expansion to Ambient Pressure

Step 4: Constant Pressure Heat Rejection

The rotary screw internal combustion engine of the invention includes a rotary screw compressor for receiving and compressing a mixture of air and fuel, a rotary positive displacement pump for receiving the compressed air and fuel mixture from the rotary screw compressor and pumping the mixture of compressed air and fuel therethrough, the pump having igniting means for igniting the mixture of compressed air and fuel inside of the pump, and a rotary screw expander for receiving the ignited mixture of compressed air and fuel and for expanding the volume of the ignited mixture of air and fuel therethrough.

The rotary screw internal combustion engine of the invention has the advantage of complete scavenging of exhaust from the combustion chamber.

An additional advantage of the rotary screw internal combustion engine of the invention is that it has no reciprocating parts.

A further advantage of the rotary screw internal combustion engine of the invention is that it has a relatively long time duration of constant volume combustion.

An even further advantage of the rotary screw internal combustion engine of the invention is that it has a relatively small size to power ratio.

DESCRIPTION OF THE PREFERRED EMBODIMENTS

Figure 1:
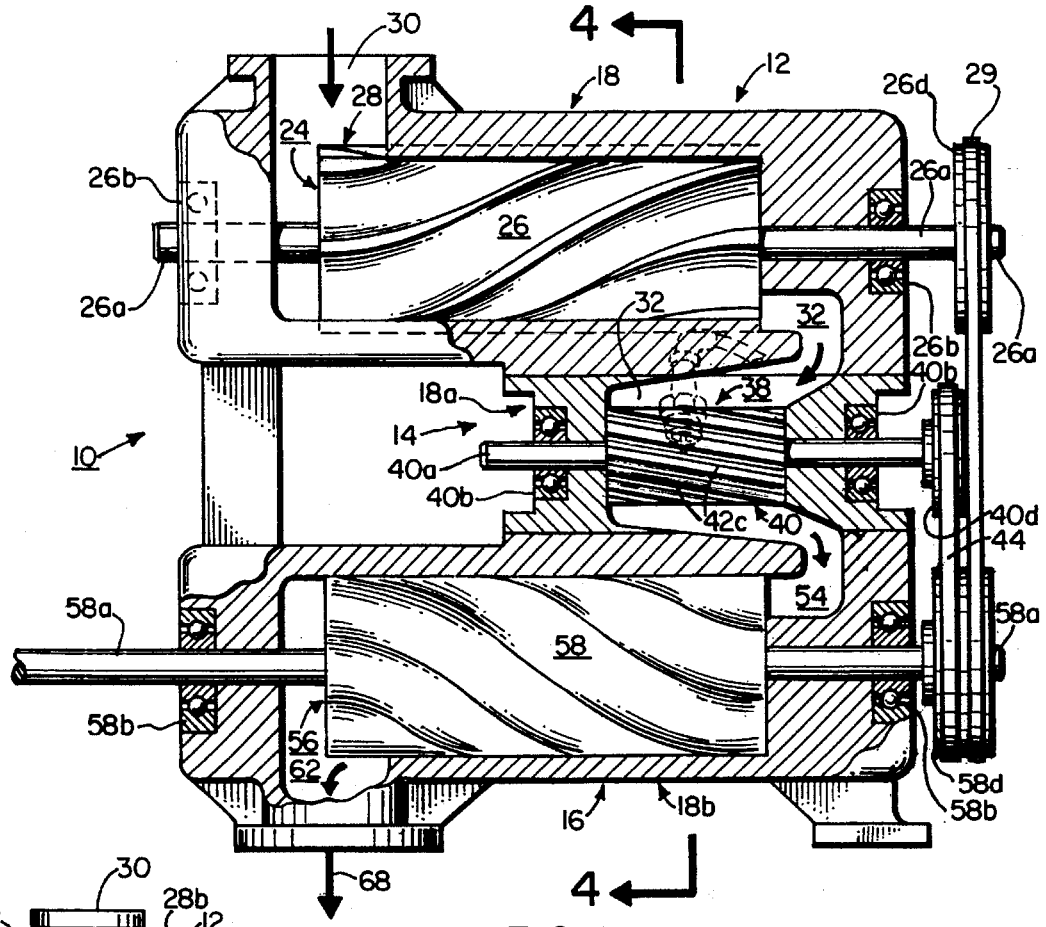
FIG. 1 is a side, elevational view, partly cut-away, partly cross-sectional, of the rotary internal combustion engine of the invention.
Figure 3:
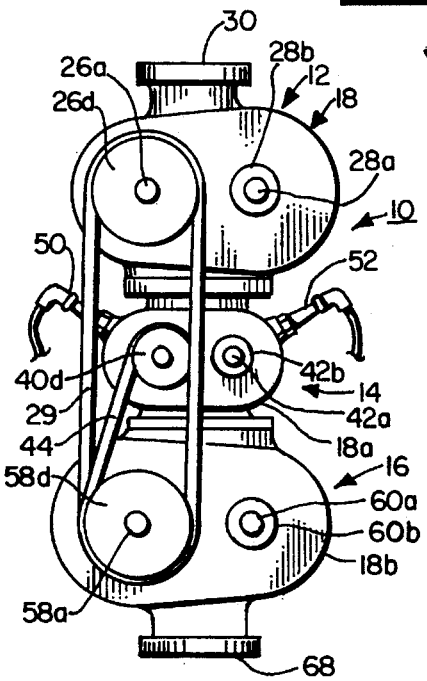
FIG. 3 is a front, elevational view of the rotary internal combustion engine of the invention.
Figure 2:
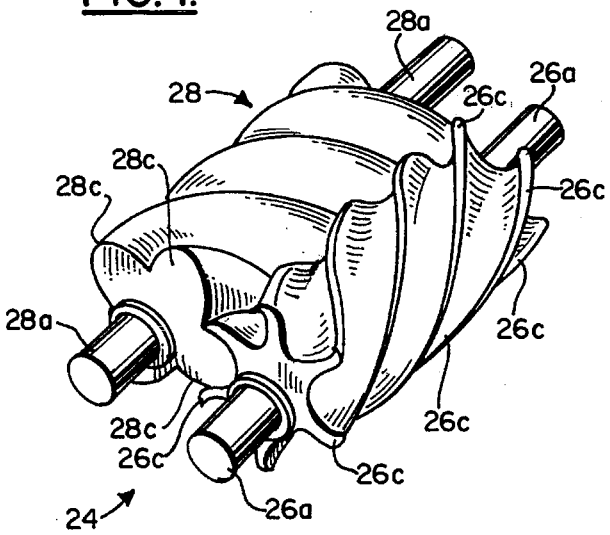
FIG. 2 is a rear, perspective view of the compressor of the rotary internal combustion engine of the invention.

Referring now to the drawings, and in particular FIGS. 1–4, there is shown the rotary screw internal combustion engine of the invention generally indicated by the numeral 10. Engine 10 includes a compressor section generally indicated by the numeral 12, a combustion section generally indicated by the numeral 14, and a power section generally indicated by the numeral 16. Compressor section 12 is rigidly connected to combustion section 14, and combustion section 14 is rigidly connected to power section 16. Rigid connection of the compressor section 12 and the power section 16 to combustion section 14 may be accomplished by any method known in the art such as bolting, welding or the like.

Engine 10, in general, operates on the complete combustion gas power cycle idealized by the following processes:

1. Isentropic compression in compressor section 12
2. Constant volume heat addition in combustion section 14.
3. Isentropic expansion to ambient pressure in power section 16.
4. Constant pressure heat rejection from power section 16 to the atmosphere.

Compressor section 12 includes a compressor housing generally indicated by the numeral 18 having two internal overlapping hollow cylindrical chambers 20 and 22. Cylindrical chambers 20 and 22 each have a central longitudinal axis 20*a* and 22*a*, respectively, which are parallel. Preferably, the diameter of cylindrical chamber 22 is greater than the diameter of cylindrical chamber 20.

Combustion section 14 includes a pump housing generally indicated by the numeral 18*a* having two internal overlapping hollow cylindrical chambers 20*b* and 22*b*. Cylindrical chambers 20*b* and 22*b* each have a central longitudinal axis 20*c* and 22*c*, respectively, which are parallel. Preferably, the diameter of cylindrical chamber 22*b* is equal to the diameter of cylindrical chamber 20*b*.

Power section 16 includes an expander housing generally indicated by the numeral 18*a* having two internal overlapping hollow cylindrical chambers 20*d* and 22*d*. Cylindrical chambers 20*d* and 22*d* each have a central longitudinal axis 20*e* and 22*e*, respectively, which are parallel. Preferably, the diameter of cylindrical chamber 22*b* is smaller than the diameter of cylindrical chamber 20*b*.

Compressor section 12 includes the rotary screw compressor generally indicated by the numeral 24 located in compressor housing 18. Rotary screw compressor 24 has two intermeshing rotors 26 and 28 rotatably mounted in overlapping hollow cylindrical chambers 20 and 22, respectively, on parallel shafts 26*a* and 28*a*, respectively. Parallel shaft 26*a* is rotatably mounted in bearings 26*b*–26*b* which are fitted in compressor housing 18, and parallel shaft 28*a* is rotatably mounted in bearings 28*b*–28*b*, all of which bearings 26*b* and 28*b* are fitted in compressor housing 18. Parallel shaft 26*a* has sheave 26*d* mounted on the front end thereof for receipt of drive belt 29.

Compressor housing 18 has an inlet port 30 and a discharge port 32. The inlet port 30 provides an inlet to compressor 24 for a mixture of air and fuel from a carburetor (not shown), throttle body or the like.

Figure 4:
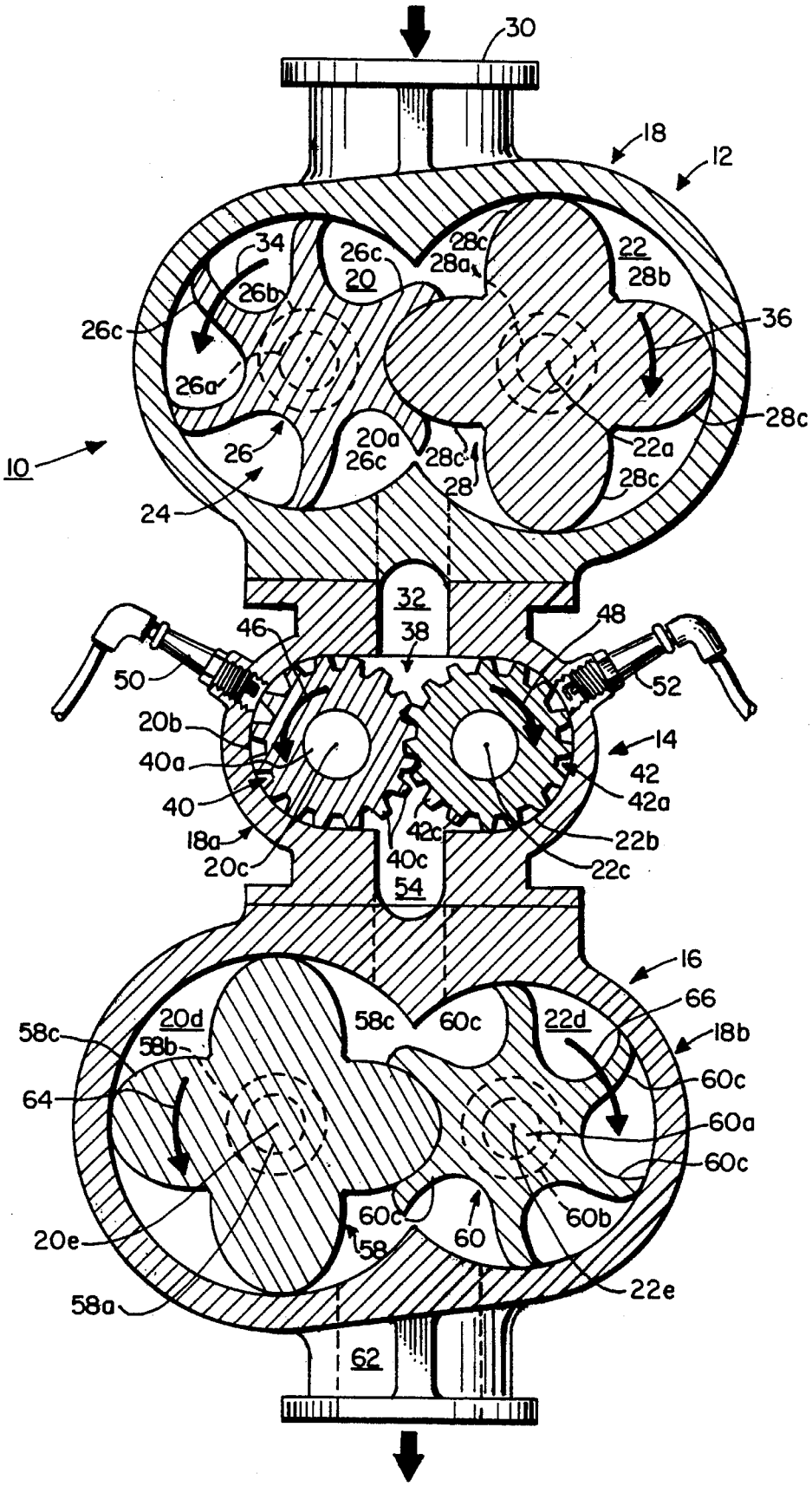
FIG. 4 is a front, cross-sectional view of the rotary internal combustion engine of the invention taken along lines 4—4 of FIG. 1.

Rotor 26 has six female flutes 26*c* and rotor 28 has four male lobes 28*c* which intermesh with the six female flutes 26*c*. When viewed from the front end as shown in FIG. 4, rotor 26 turns counter-clockwise as indicated by the arrow 34 and rotor 28 turns clockwise as indicated by the arrow 36. The two intermeshing rotors 26 and 28 trap the mixture of air and fuel entering through inlet port 30 within gas tight compartments between the female flutes 26*c*, male lobes 28*c*, and housing 18. As is known in the art, as male lobes 28*c* and female flutes 26*c* rotate in the direction indicated by arrows 36 and 34, respectively, the volume of the gas-tight compartments decrease. Thus, the mixture of air and fuel trapped within the volume bounded by female flutes 26*c*, male lobes 28*c*, and housing 18 is compressed by male lobes 28*c* along female flutes 26*c*. The compressed mixture of fuel and air exits from rotor 26 and 28 into discharge port 32.

Combustion section 14 includes the positive displacement gear pump generally indicated by the numeral 38 located in pump housing 18*a*. Gear pump 38 includes two identically shaped intermeshing elongated parallel helical gears generally indicated by the numerals 40 and 42 rotatably mounted in overlapping hollow cylindrical chambers 20*b* and 22*a*, respectively, on parallel shafts 40*a* and 42*a*, respectively. Parallel shaft 40*a* is rotatably mounted in bearings 40*b*–40*b* which are fitted in pump housing 18*a*, and parallel shaft 42*a* is rotatably mounted in bearings 42*b*–42*b* which are fitted in pump housing 18*a*. Parallel shaft 40*a* has sheave 40*d* mounted on the front end thereof for receipt of drive belt 44.

Helical gear 40 has a plurality of helical teeth 40*c* which intermesh with the plurality of helical teeth 42*c* on helical gear 42. When viewed from the front end as shown in FIG. 4, helical gear 40 turns counter-clockwise as indicated by the arrow 46 and helical gear 42 turns clockwise as indicated by the arrow 48 to pump the mixture of compressed air and fuel received from port 32 therethrough.

The mixture of fuel and air pumped from inlet 32 is ignited by spark plugs 50 and 52 while it is trapped between the rotating teeth 40*c* and 42*c*. Spark plug 50 is threaded to pump housing 18*a* and communicates with the inside of cylindrical chamber 20*b*. Spark plug 52 is threaded to pump housing 18*a* and communicates with the inside of cylindrical chamber 22*b*. The combustion of the air and fuel mixture takes place at constant volume and the combustion gases are pumped into combustion gas discharge port 54. The combustion gases are under high pressure and flow through combustion gas discharge port 54 into the expander generally indicated by the numeral 56.

Power section 16 includes the rotary screw expander generally indicated by the numeral 56 located in expander housing 18*b*. The rotary screw expander 56 is similar in shape to rotary screw compressor 24. Rotary screw expander 56 has two intermeshing rotors 58 and 60 rotatably mounted in overlapping hollow cylindrical chambers 20*d* and 22*d*, respectively, on parallel shafts 58*a* and 60*a*, respectively. Parallel shaft 58*a* is rotatably mounted in bearings 58*b*–58*b* which are fitted in expander housing 18*a*, and parallel shaft 60*a* is rotatably mounted in bearings 60*b*–60*b* which are fitted in expander housing 18*b*. Parallel shaft 58*b* has double sheave 58*d* mounted on the front end thereof for receipt of drive belt 29 and drive belt 44.

Expander housing 18*b* communicates with combustion gas discharge port 54, which also functions as an inlet port for expander 56. The combustion gas discharge port 54 provides an inlet to expander 56 for the combustion gases discharged from pump 38. Expander 56 has an exhaust port 62.

Rotor 60 has six female flutes 60*c* and rotor 58 has four male lobes 58*c* which intermesh with the six female flutes 60*c*. When viewed from the front end as shown in FIG. 4, rotor 58 turns counter-clockwise as indicated by the arrow 64 and rotor 60 turns clockwise as indicated by the arrow 66. The two intermeshing rotors 58 and 60 trap the combustion gas entering through combustion gas discharge port 54 within gas tight compartments between the female flutes 60*c*, male lobes 58*c*, and housing 18*b*. As is known in the art, as male lobes 58*c* and female flutes 60*c* rotate in the direction indicated by arrows 64 and 66, respectively, the volume of the gas-tight compartments, in which the combustion products are trapped, increase. Once the combustion products are trapped inside expander 56 and sealed from the combustion products in combustion gas discharge port 54, the hot combustion products expanded to ambient pressure inside expander 56. The high pressure combustion gases entering expander 56 from combustion gas discharge port 54 are trapped between male lobes 58*c*, female flutes 60*c*, and housing 18*b*. Male lobes 58*c* and female flutes 60*c* are forced to rotate as the combustion gases trapped between rotors 58, 60, and housing 18*b* expand by male lobes 58*c* along female flutes 60*c* inside of housing 18*b*. As the combustion gases expand along male lobes 58*c* and female flutes 60*c*, the pressure of the combustion gases decrease. The expanded combustion gases exit from rotors 58 and 60 into exhaust port 62 to the atmosphere as indicated by the arrow 68 at a pressure preferably close to ambient pressure. If desired, a conventional exhaust pipe and muffler could be connected to exhaust port 62.

The work done by the expanding combustion gases on expander 56 thus drive the expander 56 and cause rotors 58 and 60 to rotate in the direction indicated by the arrows 64 and 66. Sheave 58*d* drives gear pump 38 through belt 44 and sheave 40*d*, and sheave 58*d* drives compressor 24 through belt 29 and sheave 26*d*. The remaining work may be used to perform useful work by using shaft 58*a*, or shaft 60*a* if desired, to drive a conventional transmission to drive a vehicle, pump, or any other desired mechanism as is known to one of ordinary skill in the art.

As is known in the art, oil may be injected onto rotors 26 and 28 to lubricate flutes 26*c* and 28*c*, to maintain a seal between rotor 26 and rotor 28, and to remove the heat of compression of the mixture of air and fuel being compressed. The pump rotors and the expander rotors are preferably of the oil-free type known to those skilled in the art.

Furthermore, cooling fluids may be circulated through passages (not shown) in the compressor housing 18, the pump housing 18*a*, the expander housing 18*c*, shafts 26*a*, 28*a*, 40*a*, 42*a*, 58*a*, and 60*a* as necessary to remove heat therefrom to prevent overheating. In addition, sheaves 26*d*, 40*d*, and 58*d* could be replaced with sprockets, and belts 29 and 44 could be replaced with chains to fit the sprockets. Other drive mechanisms could be used to replace sheaves 26*d*, 40*d*, and 58*d* such as gears, and the like.

As is also known in the art, the diameter, length, and rotational speed of the rotors 26 and 28 will determine the capacity of the compressed mixture of air and fuel that will be delivered by compressor 24 to combustion section 14, and the diameter, length, and rotational speed of the rotors 58 and 60 will determine the capacity of the expanded combustion gases that will be delivered by expander 56 to exhaust port 62. As the diameter of the rotors 26 and 28, and 58 and 60, is increased, the rotational speed required to generate any given capacity of the compressed mixture of fuel and air, and combustion products, respectively, will be reduced, and vice versa.

Figure 5:
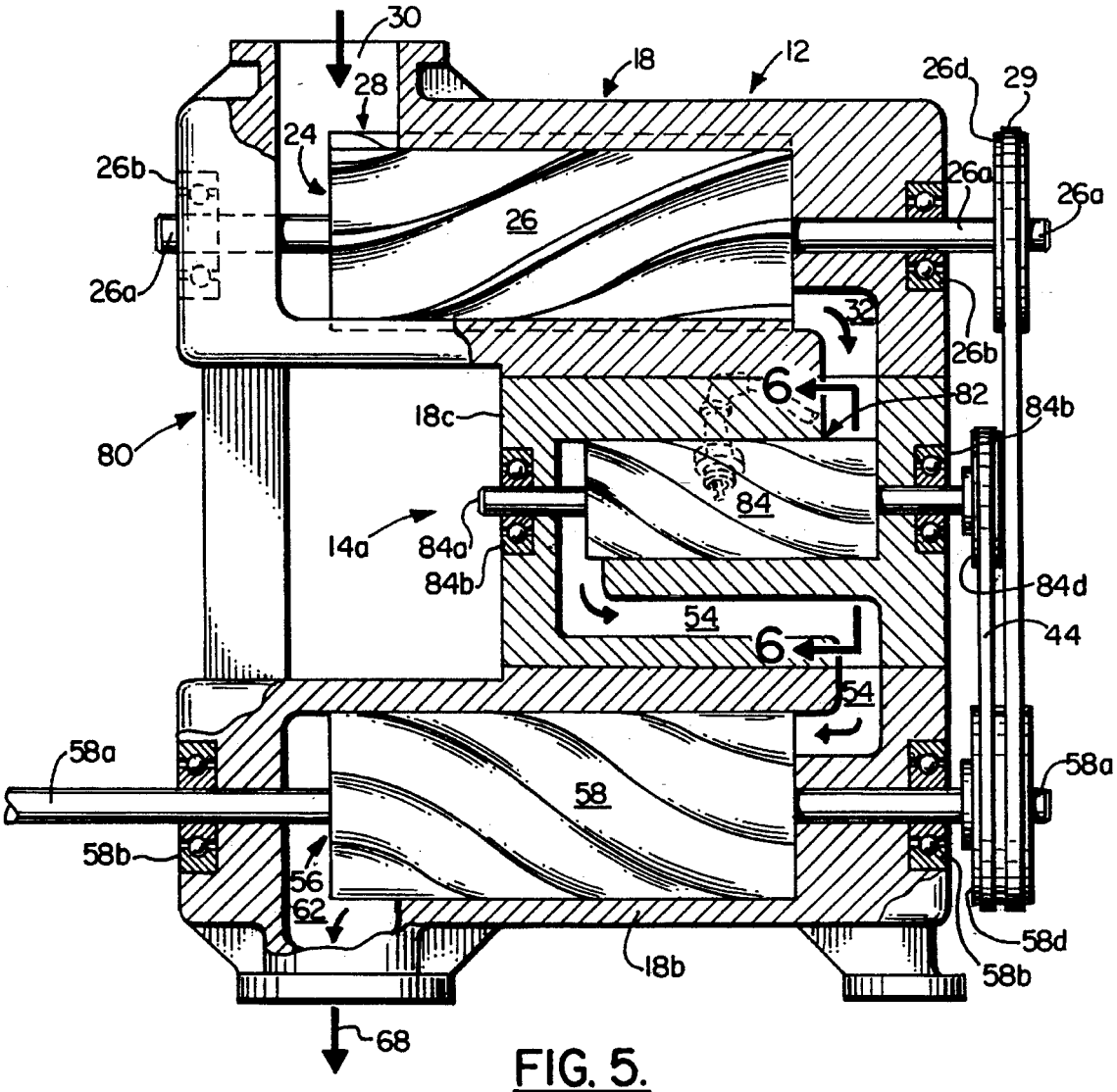
FIG. 5 is a side, elevational view, partly cut-away, partly cross-sectional, of an alternate embodiment of the rotary internal combustion engine of the invention.
Figure 6:
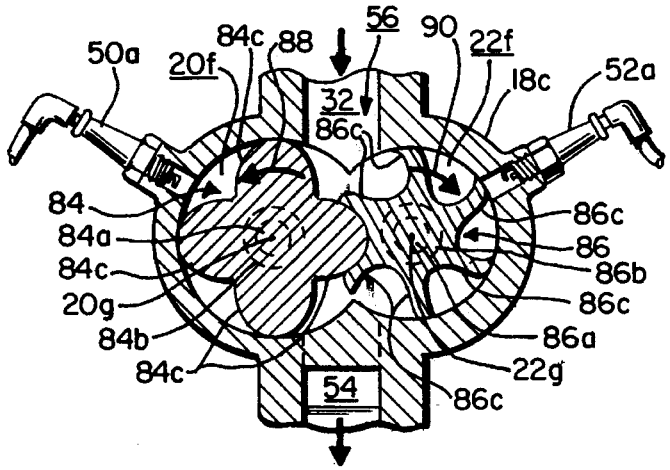
FIG. 6 is a front, partly cross-sectional view of the rotary internal combustion engine of FIG. 5 taken along lines 6—6 of FIG. 5.

In FIGS. 5 and 6 is shown an alternate embodiment of the rotary screw internal combustion engine of the invention generally indicated by the numeral 80. Engine 80 is identical to engine 10 with the exception that gear pump 38 is replaced with the rotary screw pump generally indicated by the numeral 82 rotatably mounted in pump housing 18*c*.

Combustion section 14*a* includes a pump housing generally indicated by the numeral 18*c* having two internal overlapping hollow cylindrical chambers 20*f* and 22*f*. Cylindrical chambers 20*f* and 22*f* each have a central longitudinal axis 20*g* and 22*g*, respectively, which are parallel. Preferably, the diameter of cylindrical chamber 20*f* is larger than the diameter of cylindrical chamber 22*f*.

Combustion section 14*a* includes the positive displacement rotary screw pump generally indicated by the numeral 82 located in pump housing 18*c*. Rotary screw pump 82 of engine 80 receives compressed air and fuel through port 32 from rotary screw compressor 24 as explained above in the description of engine 10. Rotary screw pump 82 has two intermeshing rotors generally indicated by the numerals 84 and 86 rotatably mounted in overlapping hollow cylindrical chambers 20*f* and 22*f*, respectively, on parallel shafts 84*a* and 86*a*, respectively. Parallel shaft 84*a* is rotatably mounted in bearings 84*b*–84*b* which are fitted in pump housing 18*c*, and parallel shaft 86*a* is rotatably mounted in bearings 86*b*–86*b*, all of which bearings 84*b* and 86*b* are fitted in pump housing 18*c*. Parallel shaft 84*a* has sheave 84*d* mounted on the front end thereof for receipt of drive belt 44. Sheave 84*d* is identical to sheave 40*d*.

Rotor 86 has six female flutes 86*c* and rotor 84 has four male lobes 84*c* which intermesh with the six female flutes 86*c*. When viewed from the front end as shown in FIG. 6, rotor 84 turns counter-clockwise as indicated by the arrow 88 and rotor 86 turns clockwise as indicated by the arrow 90. The two intermeshing rotors 84 and 86 trap the mixture of air and fuel entering through inlet port 32 within gas tight compartments between the female flutes 86*c*, male lobes 84*c*, and housing 18*c*. As is known in the art, as male lobes 84*c* and female flutes 86*c* rotate in the direction indicated by arrows 88 and 90, respectively, the volume of the gas-tight compartments remains constant. Thus, the mixture of air and fuel trapped within the female flutes 86*c*, male lobes 84*c*, and housing 18*c* is pumped at constant volume by male lobes 84*c* along female flutes 86*c* inside housing 18*c*. The mixture of fuel and air pumped from inlet 32 is ignited by spark plugs 50*a* and 52*a* while it is trapped between the rotors 84 and 86. Spark plug 50*a* is threaded to pump housing 18*c* and communicates with the inside of cylindrical chamber 20*f*. Spark plug 52*a* is threaded to pump housing 18*c* and communicates with the inside of cylindrical chamber 22*f*. The combustion of the air and fuel mixture takes place at constant volume and the combustion gases are pumped into combustion gas discharge port 54. The combustion gases are under high pressure and flow through combustion gas discharge port 54 into the expander generally indicated by the numeral 56. The expansion of the ignited combustion gases cause rotors 58 and 60 of expander 56 in engine 80 to rotate as explained above in the description of engine 10.

Lubrication and cooling of the various components of engine 80 may be accomplished as described above for engine 10. If desired, in both engine 10 and engine 80, a conventional intercooler could be utilized to cool the compressed mixture of air and fuel discharged from rotary screw compressor 24 prior to the introduction of the compressed mixture of air and fuel into rotary positive displacement pump 38 or 82.

As can be seen from the above description of the two embodiments of the invention, the compressor in both embodiments compresses the mixture of fuel and air after the mixture of fuel and air is trapped between the compressor rotors and compressor housing, and compression is completed prior to discharge from the compressor. The pump in both embodiments delivers a constant volume of the compressed mixture of fuel and air, before and after ignition, from the inlet to the exit. The expander in both embodiments enables expansion of the mixture of fuel and air after the mixture of fuel and air is trapped between the expander rotors and expander housing, and expansion is completed prior to exhaust from the expander.

The engine of the invention may include multiple stages of compression and expansion if desired, with intercooling between the compression stages if desired. Also, if desired, fuel could injected after compression prior to ignition, rather than prior to compression.

As is known to those skilled in the art, the number of male lobes and female flutes may be selected as desired. The profile of the male lobes and female flutes may be selected as desired.

Although the preferred embodiments of the invention have been described in detail above, it should be understood that the invention is in no sense limited thereby, and its scope is to be determined by that of the following claims:

What is claimed is:

1. A modular rotary screw internal combustion engine having at least three separate modules comprising:

a. a compressor module comprising a rotary screw compressor section for receiving and compressing a mixture of air and fuel, said rotary screw compressor section having a pair of intermeshing screw compressor rotors rotatably mounted in a compressor housing, each of said pair of intermeshing screw compressor rotors being rigidly connected to a rotatable shaft, each of said rotatable compressor shafts being parallel, the first compressor shaft of said pair of rotatable compressor shafts having a compressor drive means connected thereto for rotating said first compressor shaft, the second compressor shaft of said pair of rotatable compressor shafts being adapted to rotate in the opposite direction from said first compressor shaft when said first compressor shaft is rotated by said drive means, b. a combustion module comprising a rotary positive displacement pump section for receiving said compressed air and fuel mixture from said rotary screw compressor section and pumping said mixture of compressed air and fuel therethrough, said pump section having igniting means for igniting said mixture of compressed air and fuel inside of said pump section to cause constant volume combustion of said air and fuel mixture inside said pump section, said rotary positive displacement pump section having a pair of intermeshing pump rotors rotatably mounted in a pump housing, each of said pair of intermeshing pump rotors being rigidly connected to a rotatable shaft, each of said rotatable pump shafts being parallel, the first pump shaft of said pair of rotatable pump shafts having a pump drive means connected thereto for rotating said first pump shaft, the second pump shaft of said pair of rotatable pump shafts being adapted to rotate in the opposite direction from said first pump shaft when said first pump shaft is rotated by said drive means, and c. a power module comprising rotary screw expander section for receiving said ignited mixture of compressed air and fuel discharged from said pump section and permitting said ignited mixture of air and fuel to expand through said rotary screw expander section to rotate said rotary screw expander, said rotary screw expander section having a pair of intermeshing screw expander rotors rotatably mounted in an expander housing, each of said pair of intermeshing screw expander rotors being rigidly connected to a rotatable shaft, each of said rotatable expander shafts being parallel, the first expander shaft of said pair of rotatable expander shafts having an expander drive means connected thereto, said expander drive means being driven by said gases expanding in said expander section, the second expander shaft of said pair of rotatable expander shafts being adapted to rotate in the opposite direction from said first expander shaft, said expander drive means being connected to said pump section and to said rotary screw compressor section to rotate said rotary screw compressor shaft and said pump shaft.

2. The engine of claim 1 wherein the axes of rotation of said pair of compressor shafts lie in a first plane, the axes of rotation of said pair of pump shafts lie in a second plane, and the axes of rotation of said expander shafts lie in a third plane, said first plane, said second plane, and said third plane being separate planes.

3. The engine of claim 2 wherein said first plane and said second plane are parallel.

4. The engine of claim 2 wherein said first plane and said third plane are parallel.

5. The engine of claim 2 wherein said second plane and said third plane are parallel.

6. The engine of claim 1 wherein said first plane, said second plane, and said third plane are parallel.

7. The engine of claim 1 wherein the axes of rotation of said pair of compressor shafts lie in a first plane, and the axes of rotation of said pair of pump shafts lie in a second plane, said first plane and said second planes being separate planes.

8. The engine of claim 1 wherein each of said compressor shafts rotate at a rotational speed different from the rotational speed of said pump shafts.

9. The engine of claim 1 wherein each of said compressor shafts rotate at a rotational speed different from the rotational speed of said expander shafts.

10. The engine of claim 1 wherein each of said pump shafts rotate at a rotational speed different from the rotational speed of said expander shafts.

11. The engine of claim 1 wherein said rotary screw compressor section has an inlet means on one side of said compressor housing for receiving the mixture of air and fuel and a discharge means on the opposite side of said compressor housing for receiving the mixture of compressed air and fuel discharged from said pair of intermeshing screw compressor rotors.

12. The engine of claim 1 wherein said pump section has an inlet means on one side of said pump housing for receiving the mixture of compressed air and fuel from said pair of intermeshing screw compressor rotors and a discharge means on the opposite side of said pump housing for receiving the ignited mixture of compressed air and fuel discharged from said pair of intermeshing pump rotors.

13. The engine of claim 1 wherein said rotary screw expander section has an inlet means on one side of said expander housing for receiving the mixture of air and fuel that was ignited in said pump means, and a discharge means on the opposite side of said expander housing for receiving the expanded mixture of air and fuel discharged from said pair of intermeshing screw expander rotors.

14. The engine of claim 1 wherein said combustion module is connected to said power module.

15. The engine of claim 14 wherein said compressor module is connected to said combustion module.

16. The engine of claim 1 wherein said compressor module is connected to said combustion module.

17. The engine of claim 1 wherein said rotary positive displacement pump means comprises a gear pump.

18. The engine of claim 1 wherein said rotary positive displacement pump means comprises a rotary screw pump.

* * * * *